US010006588B2

(12) United States Patent
Madé et al.

(10) Patent No.: US 10,006,588 B2
(45) **Date of Patent: *Jun. 26, 2018**

(54) ARGON RECONDENSING APPARATUS

(71) Applicant: L'Air Liquide, Societe Anonyme pour l'Etude et l'Exploitation des Procedes Georges Claude, Paris (FR)

(72) Inventors: Sylvain Madé, Lasalle (CA); Yves Hardy, Saint-Sauveur (CA); Gilles Poulin, Montreal (CA)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 246 days.

This patent is subject to a terminal disclaimer.

(21) Appl. No.: 14/876,544

(22) Filed: Oct. 6, 2015

(65) Prior Publication Data

US 2016/0097489 A1 Apr. 7, 2016

Related U.S. Application Data

(60) Provisional application No. 62/060,100, filed on Oct. 6, 2014.

(51) Int. Cl.
*F17C 9/02* (2006.01)
*F25J 1/00* (2006.01)

(52) U.S. Cl.
CPC ..... *F17C 9/02* (2013.01); *F25J 1/004* (2013.01); *F25J 1/0077* (2013.01); *F17C 2265/03* (2013.01); *F17C 2265/032* (2013.01); *F17C 2265/033* (2013.01)

(58) Field of Classification Search
CPC . F25J 1/002; F25J 1/0077; F25J 1/004; F17C 9/02; F17C 2210/58; F17C 2265/03
See application file for complete search history.

(56) References Cited

U.S. PATENT DOCUMENTS

| | | | | |
|---|---|---|---|---|
| 6,336,331 | B1 * | 1/2002 | White | F25J 1/0005 62/3.1 |
| 6,427,483 | B1 * | 8/2002 | Rashad | F25B 9/006 62/613 |
| 2010/0326133 | A1 * | 12/2010 | Beeby | F25J 1/0214 62/614 |
| 2013/0118204 | A1 * | 5/2013 | Higginbotham | F25J 1/0015 62/615 |

* cited by examiner

*Primary Examiner* — Brian King
(74) *Attorney, Agent, or Firm* — Justin K. Murray

(57) ABSTRACT

An apparatus for condensing argon can include cold box, which is preferably sealed and largely maintenance free, where all instruments and valves requiring routine maintenance are to be located outside, a nitrogen separator disposed within the cold box, a heat exchanger disposed within the cold box, the heat exchanger is configured to condense a gaseous argon stream against a pressurized liquid nitrogen stream. The cold box is elevated as compared to an argon storage vessel, such that the condensed argon stream can flow to the argon storage vessel without the need for a pump.

14 Claims, 1 Drawing Sheet

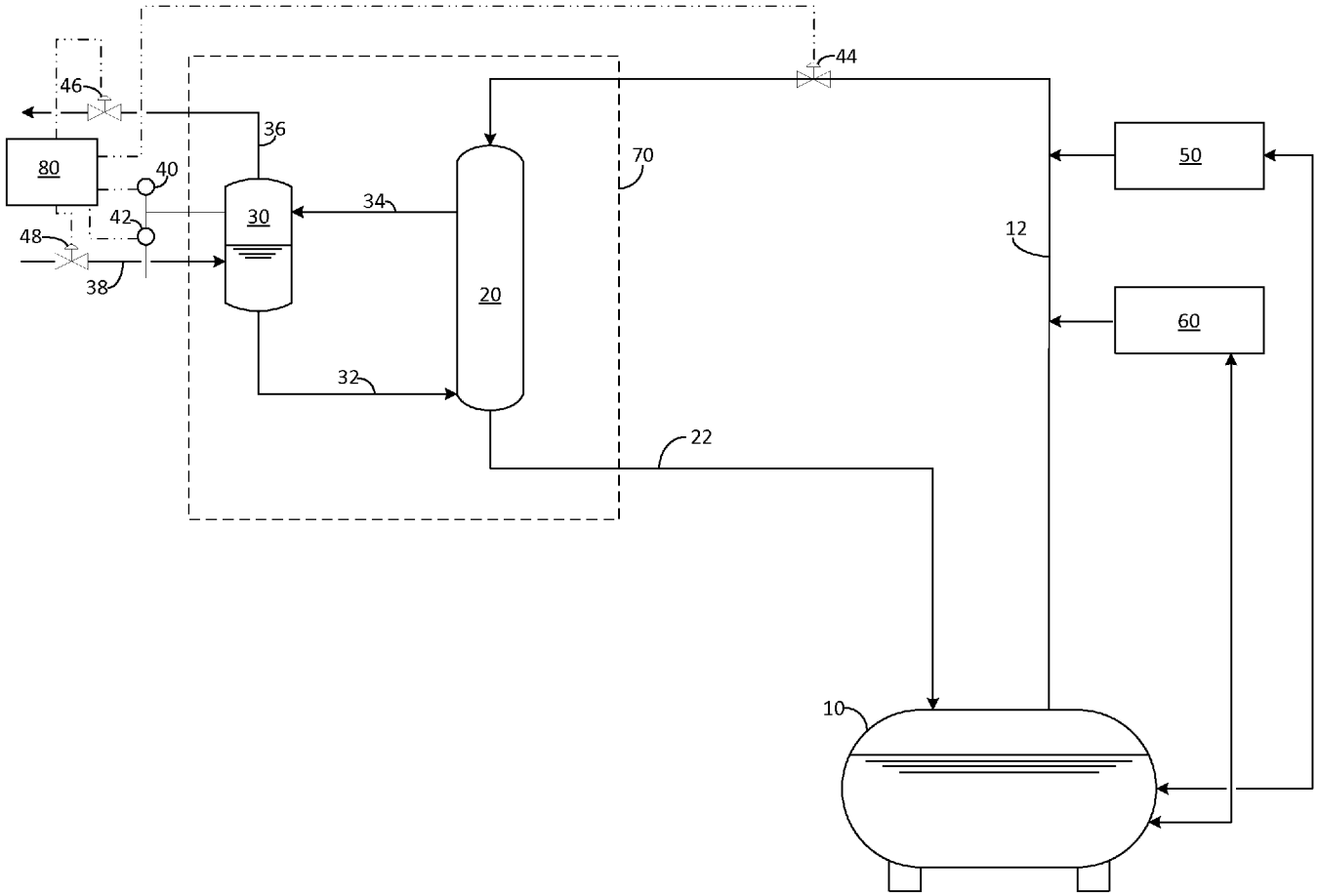
50
60
12
10
44
22
70
20
34
32
36
30
40
42
38
46
80
48

ARGON RECONDENSING APPARATUS

TECHNICAL FIELD OF THE INVENTION

The present invention relates to an apparatus and method for recovering argon vapors, particularly during loading and unloading of argon, more particularly using a cold box consisting essentially of vessels, piping, and insulation such that the need for access within the cold box is reduced significantly.

BACKGROUND OF THE INVENTION

Argon can be produced by cryogenic distillation of air, which typically contains about 0.93% of this inert gas. To facilitate its transportation to utilization sites, Argon is often liquefied (to minimize its volume) and kept in cryogenic storage tanks. Distillation of air at cryogenic temperatures is done in an insulated casing commonly known as "cold box", composed mainly of distillation columns and heat exchangers. Due to its relatively low concentration in air and the high process distillation costs, pure Argon has a high value on the market. Liquid Argon, having a boiling temperature of −303° F. at ambient pressure, is subject to evaporation when loaded into storages (e.g. storage tanks, road tankers or rail cars) at production sites. Whenever possible, it is then worthwhile to recuperate pure Argon vapors and return them to liquid storage.

In order to recuperate and condensate Argon vapors, they were traditionally sent back to the air distillation column, where integrated heat exchangers cooled by liquid Nitrogen, would condense those Argon vapors back to liquid and then returned to storage. However, existing air distillation plants, which are not equipped with such integrated heat exchangers, do not have this capability of recondensing Argon vapors. Additionally, there are times where argon storage tanks are located in areas that do not have access to distillation columns, and therefore, the prior methods are inapplicable.

SUMMARY OF THE INVENTION

The present invention is directed to a process and apparatus that satisfies at least one of these needs.

In one embodiment of the present invention, an apparatus is provided which includes an autonomous argon recondensing unit encased in a cold box, which could be installed near any liquid argon loading facilities.

In one embodiment, the apparatus includes a brazed aluminum heat exchanger installed in an elevated casing, (e.g., a "cold box") insulated to prevent heat gains from the ambient atmosphere. In one embodiment, the cold box can be physically elevated above the liquid argon storage tank to allow condensed argon to flow back by gravity to the storage tank. In one embodiment, the cold box is sealed. For purposes of this application, a sealed cold box is substantially air tight. This may be achieved by welding the seams of the cold box. In one embodiment, the sealed cold box may also include a manhole, such that a user may access the inside of the cold box in the event of a failure of the heat exchanger, vessels, or internal piping. In one embodiment, valves and other instrumentation are located outside of the cold box, and preferably at ground level, or near a platform, which is accessible by an operator. In another embodiment, all regular maintenance for valves and other instrumentation can be performed without accessing the inside of the cold box.

In another embodiment, a process for condensing argon is provided. In one embodiment, the process can include two streams, preferably in counter flow, interacting with each other in the heat exchanger: a stream of gaseous argon enters the heat exchanger to be cooled down below its liquefaction point by a stream of pressurized liquid Nitrogen entering the heat exchanger. While passing through the heat exchanger, gaseous argon is gradually cooled down until it is condensed into liquid, flowing then freely to the nearby liquid argon storage tank.

In one embodiment, a method for recovering boil-off gas during the loading and unloading of liquid argon is provided. In one embodiment, the method can include the steps of: (a) providing an argon boil-off gas; (b) providing a pressurized liquid nitrogen having a nitrogen pressure above atmospheric pressure effective to cause the liquid nitrogen to have a liquid/vapor equilibrium temperature above the freezing temperature of the argon boil-off gas; (c) heat exchanging the argon boil-off gas with the pressurized liquid nitrogen in a heat exchanger under conditions effective to recondense the argon boil-off gas to produce a condensed liquid argon and a warmed nitrogen stream, the heat exchanger disposed within a cold box; and (d) introducing the condensed liquid argon to an argon storage vessel.

In optional aspects of the method for recovering boil-off gas:

- the pressurized liquid nitrogen is stored in a nitrogen separator prior to step (c), the nitrogen separator being disposed within the cold box;
- the method can also include the step of adjusting a vent valve in fluid communication with a top portion of the nitrogen separator, wherein the vent valve is adjusted based on a condensation rate of the argon boil-off gas within the heat exchanger;
- the vent valve is disposed outside of the cold box and is accessible by a user without accessing the inside of the cold box;
- the method can also include the step of measuring the liquid level of the liquid nitrogen within the nitrogen separator and adjusting a flow rate of liquid nitrogen flowing from a liquid nitrogen storage to the nitrogen separator;
- the flow rate of liquid nitrogen is adjusted by controlling a pump and/or a control valve;
- the method can also include the step of introducing the warmed nitrogen stream from the heat exchanger to the nitrogen separator;
- the method can also include the step of withdrawing a nitrogen vent gas from the nitrogen separator;
- the method can also include adjusting the flow rate of the nitrogen vent gas as a function of an argon condensation rate of step (c);
- the method can also include the steps of measuring the pressure within the nitrogen separator; measuring the liquid level within the nitrogen separator; and measuring the temperature within the nitrogen separator;
- the respective measurements are taken using transmitters that are connected to a distributed control system (DCS), wherein the DCS is in communication with a plurality of valves that are configured to adjust process parameters, the process parameters being selected from the group consisting of pressure within the nitrogen separator, flow rate of liquid nitrogen introduced to the nitrogen separator from a liquid nitrogen storage vessel, flow rate of the argon boil-off gas entering the heat exchanger, and combinations thereof;
- the heat exchanger is a brazed aluminum heat exchanger;

the cold box is supported at an elevation above the argon storage vessel, such that the argon storage vessel is gravity fed;

the argon boil-off gas originates from a location selected from the group consisting of the argon storage vessel, a road tanker, a rail car, and combinations thereof;

the method can also include the step of routing all piping going to or from the cold box through a stainless steel plate disposed on a casing of the cold box; and/or the pressure of the pressurized liquid nitrogen is at a pressure between 15 and 30 psig.

In another embodiment, a process for condensing argon is provided. In one embodiment, the method for recovering boil-off gas during the loading and unloading of liquid argon can include the steps of: (a) providing an argon boil-off gas; (b) providing a pressurized liquid nitrogen having a nitrogen pressure above atmospheric pressure effective to cause the liquid nitrogen to have a liquid/vapor equilibrium temperature above the freezing temperature of the argon boil-off gas; (c) introducing the pressurized liquid nitrogen to a nitrogen separator; (d) heat exchanging the argon boil-off gas with the pressurized liquid nitrogen from the nitrogen separator in a heat exchanger under conditions effective to recondense the argon boil-off gas to produce a condensed liquid argon and a warmed nitrogen stream, the heat exchanger disposed within a cold box; (e) introducing the condensed liquid argon to an argon storage vessel; (f) introducing the warmed nitrogen stream from the heat exchanger to the nitrogen separator; (g) withdrawing a nitrogen vent gas from the nitrogen separator; (h) measuring the pressure within the nitrogen separator; (i) measuring the liquid level within the nitrogen separator; and (j) measuring the temperature within the nitrogen separator.

In optional aspects of the method for recovering boil-off gas:

the respective measurements of steps (h)-(j) are sent to a controller, wherein the controller is in communication with a plurality of valves that are configured to adjust process parameters, the process parameters being selected from the group consisting of the pressure within the nitrogen separator, a flow rate of liquid nitrogen introduced to the nitrogen separator from a liquid nitrogen storage vessel, a flow rate of the argon boil-off gas entering the heat exchanger, and combinations thereof;

the plurality of valves are disposed outside of the cold box and are accessible by a user without accessing the inside of the cold box; and/or the method can also include the step of performing maintenance on at least one of the plurality of valves without accessing the inside of the cold box.

In another embodiment, an apparatus for recovering boil-off gas during the loading and unloading of liquid argon originating from a location selected from the group consisting of the argon storage vessel, a road tanker, a rail car, and combinations thereof is provided. In one embodiment, the apparatus can include a) a cold box; b) a nitrogen separator disposed within the cold box; c) a heat exchanger disposed within the cold box, the heat exchanger having a warm end and a cold end, wherein the cold end comprises a nitrogen inlet and an argon outlet, wherein the nitrogen inlet is configured to receive a cold stream of liquid nitrogen, wherein the argon outlet is configured to discharge a cold stream of liquid argon, wherein the warm end comprises a nitrogen outlet and an argon inlet, wherein the nitrogen outlet is configured to discharge a warm nitrogen stream, wherein the argon inlet is configured to receive a gaseous argon stream, wherein the nitrogen inlet is in fluid communication with the nitrogen separator, wherein the nitrogen outlet is in fluid communication with an upper portion of the nitrogen separator; and d) a support structure configured to provide structural support for the cold box and to keep the cold box at an elevated height such that the heat exchanger and nitrogen separator are above the level of the argon storage vessel.

In optional aspects of the apparatus for recovering boil-off gas:

the apparatus can also a vent valve configured to control the pressure of the nitrogen separator;

the apparatus can also include a distributed control system (DCS), wherein the DCS is configured to receive a plurality of process input parameters and then adjust a plurality of process outputs;

the process input parameters are selected from the group consisting of temperature measurements of nitrogen within the nitrogen separator, pressure measurements of nitrogen within the nitrogen separator, liquid level measurements of nitrogen within the nitrogen separator, and combinations thereof;

the plurality of process outputs comprises a plurality of set points for a valve, the valve selected from the group consisting of a liquid nitrogen valve configured to control the flow rate of liquid nitrogen sent to the nitrogen separator, a vent valve configured to reduce the pressure of the nitrogen separator by allowing nitrogen gas to vent from the nitrogen separator, and an argon control valve configured to control the flow rate of the gaseous argon stream entering the argon inlet of the heat exchanger, and combinations thereof;

the DCS is configured to open and close the vent valve based upon an argon condensation rate within the heat exchanger;

the DCS is configured to open and close the vent valve based upon the pressure within the nitrogen separator;

the vent valve, the argon control valve, and the liquid nitrogen valve are disposed outside of the cold box;

the vent valve, the argon control valve, and the liquid nitrogen valve are disposed near ground level such that the valves are accessible by a user without use of a ladder or stairs;

the apparatus can also include a liquid nitrogen pump in fluid communication with the nitrogen separator and a nitrogen storage vessel, wherein the liquid nitrogen pump is configured to pressurize liquid nitrogen to a nitrogen pressure above atmospheric pressure effective to cause the liquid nitrogen to have a liquid/vapor equilibrium temperature above the freezing temperature of argon;

the heat exchanger is a brazed aluminum heat exchanger;

the cold box is at an elevation above the argon storage vessel, such that the argon storage vessel is gravity fed;

the argon inlet of the heat exchanger is in fluid communication with an argon boil-off gas source selected from the group consisting of the argon storage vessel, a road tanker, a rail car, and combinations thereof;

the apparatus can also include means for measuring the liquid level of the liquid nitrogen within the nitrogen separator and means for adjusting a flow rate of liquid nitrogen flowing from a nitrogen storage vessel to the nitrogen separator;

the means for adjusting the flow rate of liquid nitrogen are selected from the group consisting of a liquid nitrogen pump, a control valve, and combinations thereof; and/or the apparatus can also include a stainless steel plate disposed on a casing of the cold box.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The FIGURE shows an embodiment of the present invention.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

In one embodiment, the apparatus includes a brazed aluminum heat exchanger installed in an elevated casing, a "cold box", insulated to prevent heat gains from the ambient atmosphere. In one embodiment, the cold box can be physically elevated above the liquid argon storage tank to allow condensed argon to flow back by gravity to the storage tank.

In another embodiment, a process for condensing argon is provided. In one embodiment, the process can include two flow streams, preferably counter flow, interacting with each other in the heat exchanger: a stream of gaseous argon enters the heat exchanger to be cooled down below its liquefaction point by a stream of pressurized liquid nitrogen entering the heat exchanger. While passing through the heat exchanger, gaseous argon is gradually cooled down until it is condensed into liquid, flowing then freely to the nearby liquid argon storage tank.

In one embodiment, all valves and instrumentation can be located outside of the cold box, and preferably, at ground level. This will greatly facilitate maintenance and operation, while avoiding the need for any platforms or ladders to be installed to access the cold box. In another embodiment, all piping going to or from the cold box can be routed through a stainless steel plate on the cold box casing. In a preferred embodiment, the choice of a resilient material, such as stainless steel, is made to counteract the extremely cold temperatures of the piping being in contact with the casing at entry points.

In one embodiment, to avoid freezing of the argon, liquid nitrogen within a separator vessel (i.e., nitrogen separator) is at a sufficient pressure in order to ensure that its liquid/vapor equilibrium temperature is just above the argon freezing temperature. In one embodiment, the liquid nitrogen pressure can be maintained and controlled via a pressure controller which is sensing the internal pressure of the separator vessel, when the higher pressure setting is reached, the vent valve opens until the normal setting is re-established, then the valve closes. In another embodiment, the vent valve may act as a back-pressure for the entire loop. In one embodiment, the liquid nitrogen source can be coming from high pressure storages or from the liquid nitrogen pump while the discharge pressure will be regulated down to meet the required pressure for condensing the argon.

In one embodiment, to maintain a constant level in the separator vessel, liquid nitrogen can be automatically pumped from a liquid nitrogen storage. Automation of this embodiment can be realized by having temperature, pressure, and level transmitters, connected to a DCS, controlling an automated level valve and pump controls. Nitrogen pressure and optionally liquid level in nitrogen separator, which control the liquid nitrogen temperature and thus argon condensation rate and liquid argon temperature, can be controlled by an automated vent valve in fluid communication with the nitrogen separator. In one embodiment, the temperature of the nitrogen within the nitrogen separator can be measured by measuring the temperature of the nitrogen at outlet/inlet lines coming from/going into the cold box. This allows temperature measurements to be taken without having to access the inside of the cold box.

In an additional embodiment, the method can also include adjusting the storage and/or operating pressure of the liquid nitrogen, such that the liquid nitrogen has a liquid/vapor equilibrium temperature that is warmer than the freezing point of the boil-off gas, thereby reducing the risk of solids forming within the heat exchanger and/or lines. As an example, argon becomes a solid at about −309° F. and nitrogen has a boiling point of about −321° F. at 1 atm. However, by maintaining liquid nitrogen within a pressure range of 15-30 psig, the boiling point of the liquid nitrogen rises to about −300° F. to −308° F., thereby eliminating the opportunity of creating solid argon.

The FIGURE illustrates a process flow diagram in accordance with an embodiment of the present invention. Argon storage vessel 10 contains liquid argon. During loading of argon into argon storage vessel 10, the pressure within argon storage vessel 10 increases. In order to prevent an unsafe condition, boil-off gas is withdrawn as stream 12 and sent to heat exchanger 20 to be condensed therein. Heat exchanger 20 is located within cold box 70 and is in an elevated position relative to argon storage vessel 10, such that condensed argon 22 can be gravity fed to argon storage vessel 10.

Argon storage vessel 10 is configured to receive and/or transfer liquid argon to a road tanker 50 and/or a rail car 60. Additionally, stream 12 can include argon boil-off gas from argon storage vessel 10, as well as road tanker 50 and rail car 60.

Nitrogen separator 30 contains a volume of liquid nitrogen. During operation, liquid nitrogen is fed via stream 32 to the cold end of heat exchanger 20 and exchanges heat with the incoming argon gas, resulting in condensed argon 22 and warmed nitrogen 34. In the embodiment shown, warmed nitrogen 34 is recycled back to nitrogen separator 30. In an alternate embodiment, warmed nitrogen 34 can be vented to the atmosphere.

In the embodiment shown, the condensation rate of the argon can be controlled by controlling the temperature of the liquid nitrogen, which is ultimately affected by the nitrogen pressure of nitrogen separator 30. Additionally, the nitrogen pressure of nitrogen separator 30 can be directly controlled by the flow rate of nitrogen vent gas 36, which can be controlled by vent valve 46.

In the embodiment shown, pressure indicator 40 and liquid indicator 42 measure the pressure and liquid levels, respectively, within nitrogen separator 30, and transmit those measurements to a controller 80, preferably of the distributed control system (DCS) type. The controller 80 then adjusts the flow rates of argon gas (stream 12), nitrogen vent gas 36, and liquid nitrogen 38, via valves 44, 46, and 48, respectively. Cold box 70 is preferably supported by support structure (not shown), which is configured to physically support the cold box at an elevated height as compared to argon storage vessel 10. While not indicated as such in the FIGURE, all valves and other instrumentation (e.g., 40, 42, 44, 46, 48, 80) are preferably located near ground level such that they can be accessed by an operator without the use of any other lifting equipment (e.g., ladders, stairs, lifts, etc . . . ). This will greatly facilitate maintenance and operation, while avoiding the need for any platforms or ladders to be installed to access the cold box. In a preferred embodiment, the insides of the cold box, which in one embodiment contains essentially only piping, insulation, the nitrogen separator, and the heat exchanger, will be essentially maintenance free.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps or devices can be combined into a single step/device.

The singular forms "a", "an", and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. An apparatus for recovering boil-off gas during the loading and unloading of liquid argon originating from a location selected from the group consisting of the argon storage vessel, a road tanker, a rail car, and combinations thereof, the apparatus comprising:

a) a cold box;

b) a nitrogen separator disposed within the cold box;

c) a heat exchanger disposed within the cold box, the heat exchanger having a warm end and a cold end, wherein the cold end comprises a nitrogen inlet and an argon outlet, wherein the nitrogen inlet is configured to receive a cold stream of liquid nitrogen, wherein the argon outlet is configured to discharge a cold stream of liquid argon, wherein the warm end comprises a nitrogen outlet and an argon inlet, wherein the nitrogen outlet is configured to discharge a warm nitrogen stream, wherein the argon inlet is configured to receive a gaseous argon stream, wherein the nitrogen inlet is in fluid communication with the nitrogen separator, wherein the nitrogen outlet is in fluid communication with an upper portion of the nitrogen separator;

d) a support structure configured to provide structural support for the cold box and to keep the cold box at an elevated height such that the heat exchanger and nitrogen separator are above the level of the argon storage vessel;

e) a vent valve configured to control the pressure of the nitrogen separator; and f) a distributed control system (DCS), wherein the DCS is configured to receive a plurality of process input parameters and then adjust a plurality of process outputs.

2. The apparatus as claimed in claim 1, wherein the process input parameters are selected from the group consisting of temperature measurements of nitrogen within the nitrogen separator, pressure measurements of nitrogen within the nitrogen separator, liquid level measurements of nitrogen within the nitrogen separator, and combinations thereof.

3. The apparatus as claimed in claim 1, wherein the plurality of process outputs comprises a plurality of set points for a first valve, the first valve selected from the group consisting of a liquid nitrogen valve configured to control the flow rate of liquid nitrogen sent to the nitrogen separator, the vent valve, and an argon control valve configured to control the flow rate of the gaseous argon stream entering the argon inlet of the heat exchanger, and combinations thereof.

4. The apparatus as claimed in claim 3, wherein the DCS is configured to open and close the vent valve based upon an argon condensation rate within the heat exchanger.

5. The apparatus as claimed in claim 3, wherein the DCS is configured to open and close the vent valve based upon the pressure within the nitrogen separator.

6. The apparatus as claimed in claim 3, wherein the first valve is disposed outside of the cold box.

7. The apparatus as claimed in claim 6, wherein the first valve is disposed near ground level such that the first valve is accessible by a user without use of a ladder or stairs.

8. The apparatus as claimed in claim 1, further comprising a liquid nitrogen pump in fluid communication with the nitrogen separator and a nitrogen storage vessel, wherein the liquid nitrogen pump is configured to pressurize liquid nitrogen to a nitrogen pressure above atmospheric pressure effective to cause the liquid nitrogen to have a liquid/vapor equilibrium temperature above the freezing temperature of argon.

9. The apparatus as claimed in claim 1, wherein the heat exchanger is a brazed aluminum heat exchanger.

10. The apparatus as claimed in claim 1, wherein the cold box is at an elevation above the argon storage vessel, such that the argon storage vessel is gravity fed.

11. The apparatus as claimed in claim 1, wherein the argon inlet of the heat exchanger is in fluid communication with an argon boil-off gas source selected from the group consisting of the argon storage vessel, a road tanker, a rail car, and combinations thereof.

12. The apparatus as claimed in claim 1, further comprising means for measuring the liquid level of the liquid nitrogen within the nitrogen separator and means for adjusting a flow rate of liquid nitrogen flowing from a nitrogen storage vessel to the nitrogen separator.

13. The apparatus as claimed in claim 12, wherein the means for adjusting the flow rate of liquid nitrogen are selected from the group consisting of a liquid nitrogen pump, a control valve, and combinations thereof.

14. The apparatus as claimed in claim 1, further comprising a stainless steel plate disposed on a casing of the cold box.

* * * * *